US010611045B2

(12) United States Patent
Jeng

(10) Patent No.: US 10,611,045 B2
(45) Date of Patent: Apr. 7, 2020

(54) CARL PUNCHER SYSTEM FOR VEHICLE SEAT COVER

(71) Applicant: Sam In Jeng, Seongnam-si (KR)

(72) Inventor: Sam In Jeng, Seongnam-si (KR)

( * ) Notice: Subject to any disclaimer, the term of this patent is extended or adjusted under 35 U.S.C. 154(b) by 0 days.

(21) Appl. No.: 16/329,518

(22) PCT Filed: Jun. 21, 2017

(86) PCT No.: PCT/KR2017/006515
§ 371 (c)(1),
(2) Date: Feb. 28, 2019

(87) PCT Pub. No.: WO2018/048070
PCT Pub. Date: Mar. 15, 2018

(65) Prior Publication Data

US 2019/0193295 A1 Jun. 27, 2019

(30) Foreign Application Priority Data

Sep. 7, 2016 (KR) ..... 10-2016-0114904

(51) Int. Cl.
*B26F 1/02* (2006.01)
*B26F 1/24* (2006.01)
(Continued)

(52) U.S. Cl.
CPC ..... *B26F 1/02* (2013.01); *B26D 5/00* (2013.01); *B26F 1/24* (2013.01); *B26F 1/40* (2013.01); *Y10T 83/943* (2015.04)

(58) Field of Classification Search
CPC ..... B26F 1/02; B26F 1/24; B26F 1/40; B26F 1/14; B26F 2210/12; B26D 5/00;
(Continued)

(56) References Cited

U.S. PATENT DOCUMENTS 1,942,539 A * 1/1934 Deubel ..... C14B 5/02 83/684
2004/0168560 A1* 9/2004 Halamoda ..... B26D 7/1854 83/687
(Continued)

FOREIGN PATENT DOCUMENTS

JP 08-132395 A 5/1996
JP 2013-123597 A 6/2013
(Continued)

*Primary Examiner* — Phong H Nguyen
(74) *Attorney, Agent, or Firm* — Rabin & Berdo, P.C.

(57) ABSTRACT

A Carl punch system for a vehicle seat cover. A guide (104) is installed above the upper surface of a base (102). A controller (106) is installed on the outer surface of the base (102) to control the Carl punch system according to a predetermined program. A Carl punch means (108) is disposed on the central upper surface of the base (102) to punch a seat cover to produce vent holes with a pattern desired by a user in the seat cover. A press (110) is vertically slidably installed on the guide (104) and electrically connected to the controller (106) so as to press the Carl punch means (108) disposed on the central upper surface of the base (102) according to a control signal from the controller (106). The Carl punch system has improved productivity and workability.

1 Claim, 10 Drawing Sheets

(51) Int. Cl.
*B26D 5/00* (2006.01)
*B26F 1/40* (2006.01)

(58) Field of Classification Search
CPC ..... B26D 7/00; B26D 7/20; Y10T 83/943; Y10T 83/9423; Y10T 83/944; Y10S 83/936
See application file for complete search history.

(56) References Cited

U.S. PATENT DOCUMENTS

| | | | | |
|---|---|---|---|---|
| 2005/0132856 | A1* | 6/2005 | Geffros | B26D 7/18 83/164 |
| 2008/0282864 | A1* | 11/2008 | Horn | B26D 5/08 83/549 |
| 2014/0130323 | A1* | 5/2014 | Asai | B26D 7/26 29/402.01 |
| 2014/0260438 | A1* | 9/2014 | Matsumura | B26F 1/02 69/2 |
| 2015/0000485 | A1* | 1/2015 | Piro | B26F 1/02 83/30 |
| 2017/0274549 | A1* | 9/2017 | Sculthorpe | B26D 5/005 |

FOREIGN PATENT DOCUMENTS

| | | | |
|---|---|---|---|
| KR | 10-0883847 | B1 | 2/2009 |
| KR | 10-0893932 | B1 | 4/2009 |
| KR | 10-2010-0124056 | A | 11/2010 |
| KR | 10-1419454 | B1 | 7/2014 |

* cited by examiner

CARL PUNCHER SYSTEM FOR VEHICLE SEAT COVER

TECHNICAL FIELD

The present disclosure relates to a Carl punching system and, more particularly, to a Carl punching system for a vehicle seat cover, the Carl punching system being configured to punch ventilation holes in a seat cover according to a design desired by a user in a short time, thereby improving productivity and workability.

BACKGROUND ART

In general, seat covers have ventilation holes and are widely used not only on the backrests of vehicle seats, but also on domestic furniture.

Such covers are generally made of natural leather or synthetic leather.

In addition, ventilation holes in a seat cover are formed by punching the seat cover using a punching machine (or punching system).

An invention for forming ventilation holes in a seat cover using punching pins of a punching machine has been filed in the Korean Intellectual Property Office (KIPO).

Korean Patent Application No. 10-2009-0043104, dated on May 18, 2009 (titled: "PUNCHING APPARATUS FOR LEATHER"), filed in the KIPO will be described with reference to FIG. 1. According to the claims of this document, a punching machine for leather includes: a table 10 including a work board 12, a stand 11 provided above the work board 12, and four legs 13 supporting the lower portion of the work board 12; a punching unit 20 including an upwardly and downwardly-movable cylinder 21 disposed below and connected to the stand 11, and a punching pin 22 being moved up and down by the operation of the cylinder 21; a geared leather feed unit 30 including a rotary moving member 32 having grooves 31 formed in the outer circumference thereof and configured to rotate in one direction to move a sheet of leather placed thereon, an elastic pin 33 elastically entering the grooves 31 of the rotary moving member 32, and a cylinder 34 engaged with the elastic pin 33 to move the elastic pin 33 back and forth; and a support bearing 40 located above the rotary moving member 32 of the geared leather feed unit 30 and axially disposed on a support shaft 41 to support the upper portion of the sheet of leather located above the rotary moving member 32. A guide 14 is further provided in front of the stand 11 of the table 10, an up/down limiter 23 is further provided on a portion of the guide 14 to be electrically connected to the cylinder 21, and a contact 24 is further provided adjacently to one side of the punching pin 22 of the punching unit 20 to be guided up and down by the guide 13 provided in front of the stand 11 to come into contact with the up/down limiter 23.

However, the punching machine for leather of the related art fails to punch ventilation holes in a leather sheet of furniture (or a sheet cover) according to a design desired by the user in a short time, which is problematic.

Accordingly, problems of significantly low productivity and workability have resulted.

DISCLOSURE

Technical Problem

Accordingly, the present disclosure has been made in consideration of the above-described problems occurring in the related art, and the present disclosure proposes a Carl punching system for a vehicle seat cover, the Carl punching system being configured to punch ventilation holes in a seat cover according to a design desired by a user in a short time, thereby improving productivity and workability.

However, the object of the present disclosure is not limited to the aforementioned description, and other objects not explicitly disclosed herein will be clearly understood by a person having ordinary skill in the art from the description provided hereinafter.

Technical Solution

To obtain the foregoing object, according to an aspect of the present disclosure, a Carl punching system for a vehicle seat include:

a base (102);

guides (104) disposed on a top surface of the base (102), and spaced apart from each other by predetermined distances;

a controller (106) disposed on an outer surface portion of the base (102) to control the Carl punching system for a vehicle seat, according to a preset program;

a Carl punching unit (108) located on a central portion of a top surface of the base (102) to punch ventilation holes in a seat cover according to a design desired by a user; and a press (110) disposed on the guides (104) to be slidable upwardly or downwardly and electrically connected to the controller (106) to press the Carl punching unit (108) located on the central portion of the top surface of the base (102) in response to a control signal from the controller (106), wherein the Carl punching unit (108) includes:

a Carl punching plate (112) having a plurality of through-holes;

Carl punching pins (114) interference-fitted into the through-holes of the Carl punching plate (112) and protruding from a top surface of the Carl punching plate (112) to punch ventilation holes in a seat cover; and a support plate (116) closely fixed to a bottom surface of the Carl punching plate (112) to support the Carl punching plate (112), with through-holes corresponding to the through-holes of the Carl punching plate (112) being formed in the support plate (116).

The through-holes of the support plate (116) are located on the same vertical lines as the through-holes of the Carl punching plate (112), with an inner diameter of the through-holes of the support plate (116) being smaller than an inner diameter of the through-holes of the Carl punching plate (112), The Carl punching pins (114) are groups of Carl punching pins, including:

a first group, a second group, a third group, . . . , and Nth group of Carl punching pins, interference-fitted into the through-holes of the punching plate 112, such that the ventilation holes are punched in the seat cover in the design desired by the user, A bottom surface of the support plate (116) defines force-distributing groups (118) corresponding to the groups of Carl punching pins interference-fitted into the Carl punching plate (112) to distribute force of the Carl punching pins (114) when pressed by the press (110), the bottom surface of the support plate (116) being more inclined toward predetermined portions of the force-distributing groups (118).

Each of the Carl punching pins (114) further includes:

a flange (120) on outer circumferential portions of a central portion thereof.

After a seat cover (200) to be punched is located on the top surface of the Carl punching plate (112), into which the Carl punching pins (114) are interference-fitted, a paper sheet (300) is located on a top surface of the seat cover (200).

Advantageous Effects

As set forth above, the Carl punching system for a vehicle seat cover, according to the present disclosure, can punch ventilation holes in a seat cover according to a design desired by a user in a short time, thereby improving productivity and workability.

MODE FOR INVENTION

Hereinafter, a Carl punching system for a vehicle seat cover according to exemplary embodiments of the present disclosure will be described. In the following description of the present disclosure, detailed descriptions of known functions and components incorporated herein will be omitted in the case that the subject matter of the present disclosure may be rendered unclear thereby.

Figure 1:
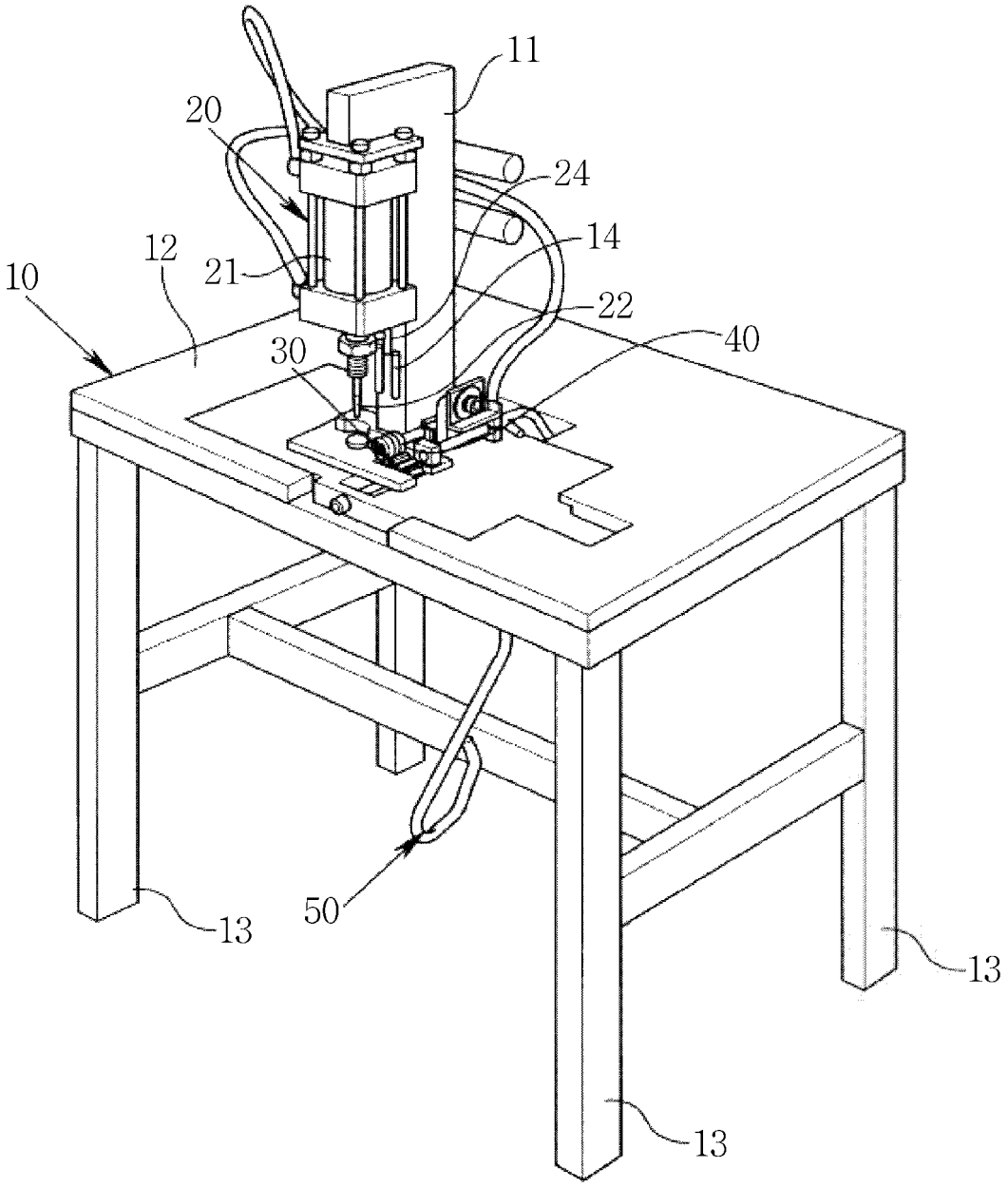
FIG. 1 Prior Art
FIG. 1 is a view illustrating a leather punching machine for domestic furniture of the related art.
Figure 2:
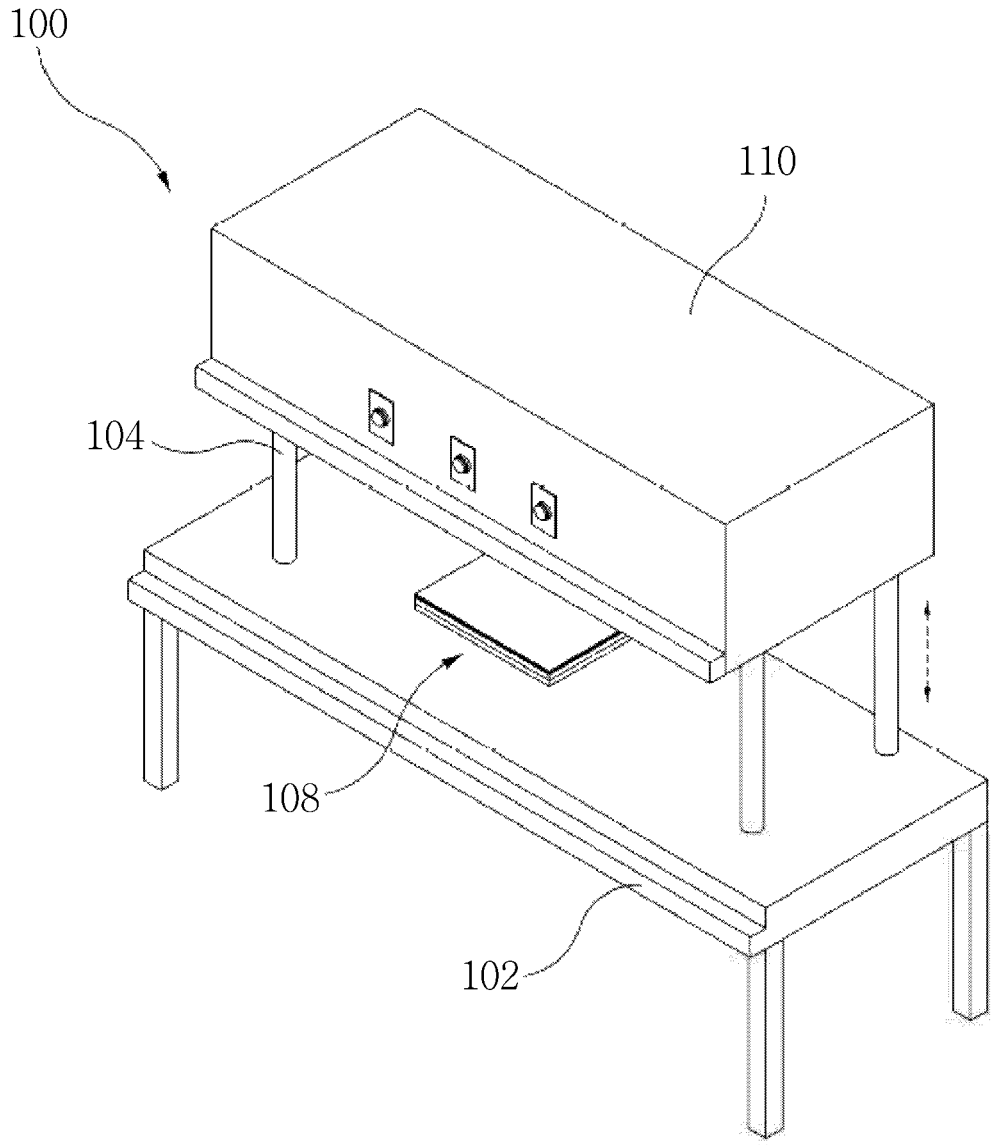
FIG. 2 is a view illustrating a Carl punching system for a vehicle seat cover according to the present disclosure.
Figure 3:
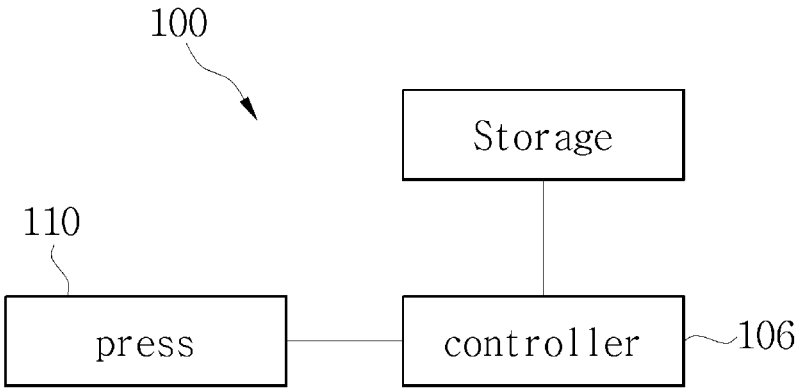
FIG. 3 is a schematic configuration view of the Carl punching system for a vehicle seat cover illustrated in FIG. 2.
Figure 4:
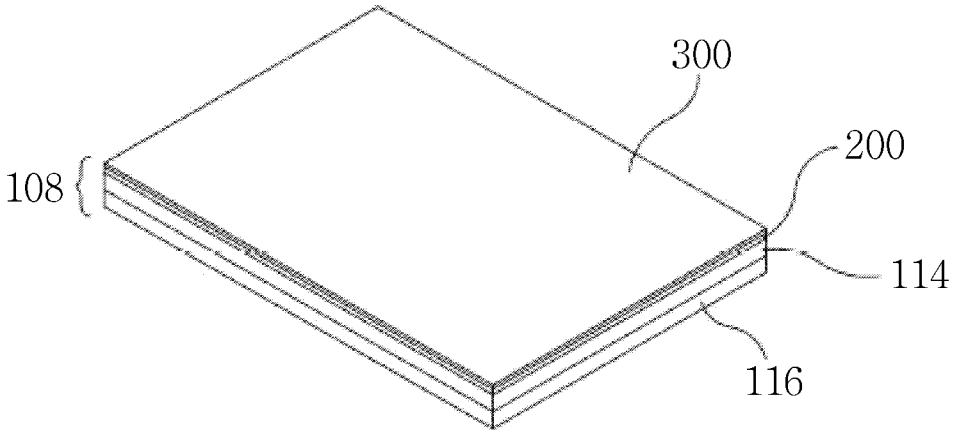
FIG. 4 is an enlarged view of the Carl punching unit of the Carl punching system for a vehicle seat cover illustrated in FIG. 2.

FIG. 2 is a view illustrating a Carl punching system for a vehicle seat cover according to the present disclosure, FIG. 3 is a schematic configuration view of the Carl punching system for a vehicle seat cover illustrated in FIG. 2, and FIG. 4 is an enlarged view of the Carl punching unit of the Carl punching system for a vehicle seat cover illustrated in FIG. 2.

As illustrated in FIGS. 2 to 4, the Carl punching system 100 for a vehicle seat cover according to the present disclosure includes:

a base 102;

guides 104 disposed on the top surface of the base 102 at predetermined distances from each other;

a controller 106 disposed on an outer surface portion of the base 102 to control the Carl punching system for a vehicle seat, according to a preset program;

a Carl punching unit 108 located on the central portion of the top surface of the base 102 to punch ventilation holes in a seat cover according to a design desired by a user; and a press 110 disposed on the guides 104 to be slidable up or down and electrically connected to the controller 106 to press the Carl punching unit 108 located on the central portion of the top surface of the base 102 in response to a control signal from the controller 106.

Figure 5:
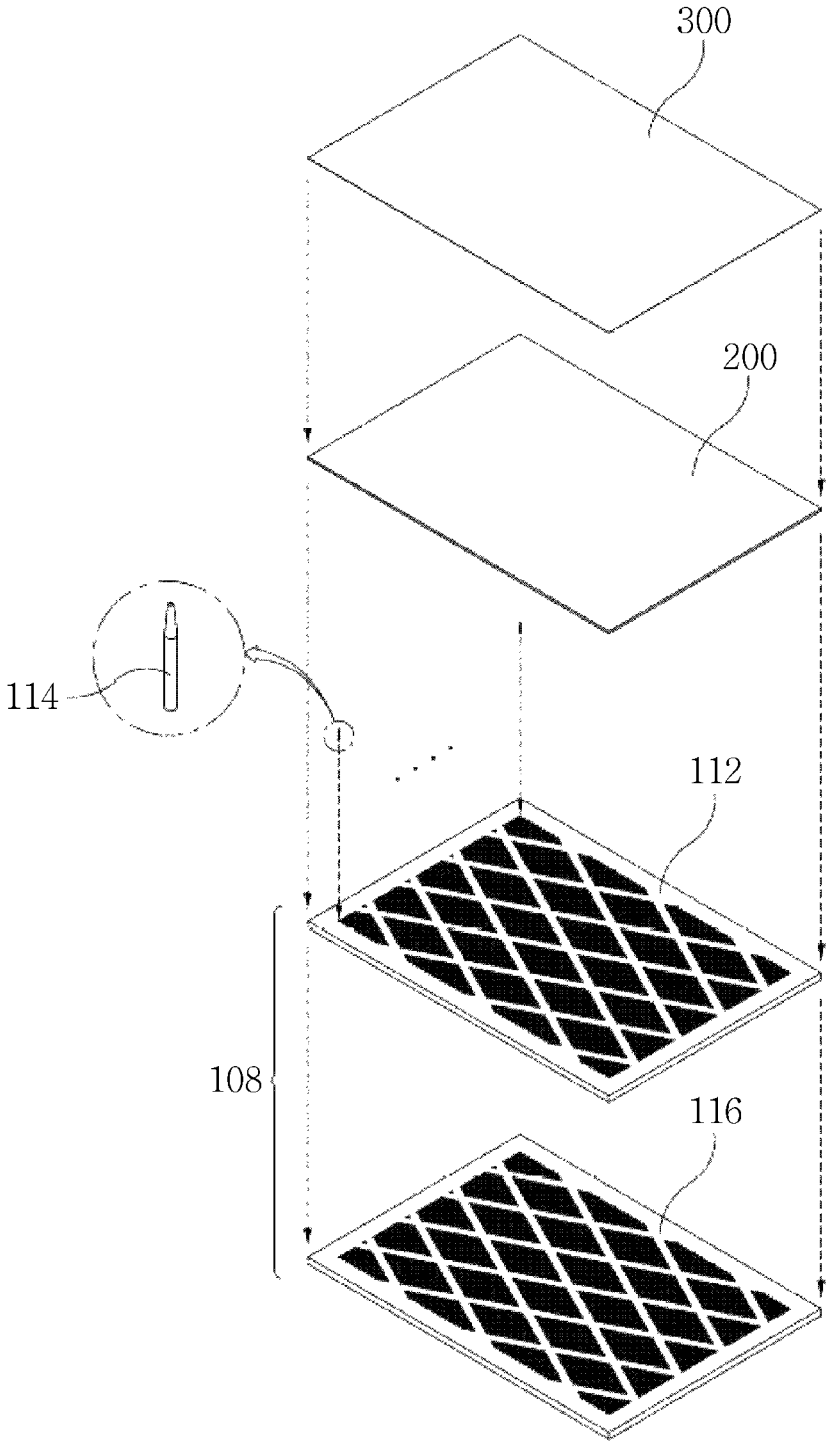
FIG. 5 is an exploded view of the Carl punching unit illustrated in FIG. 4.
Figure 6:
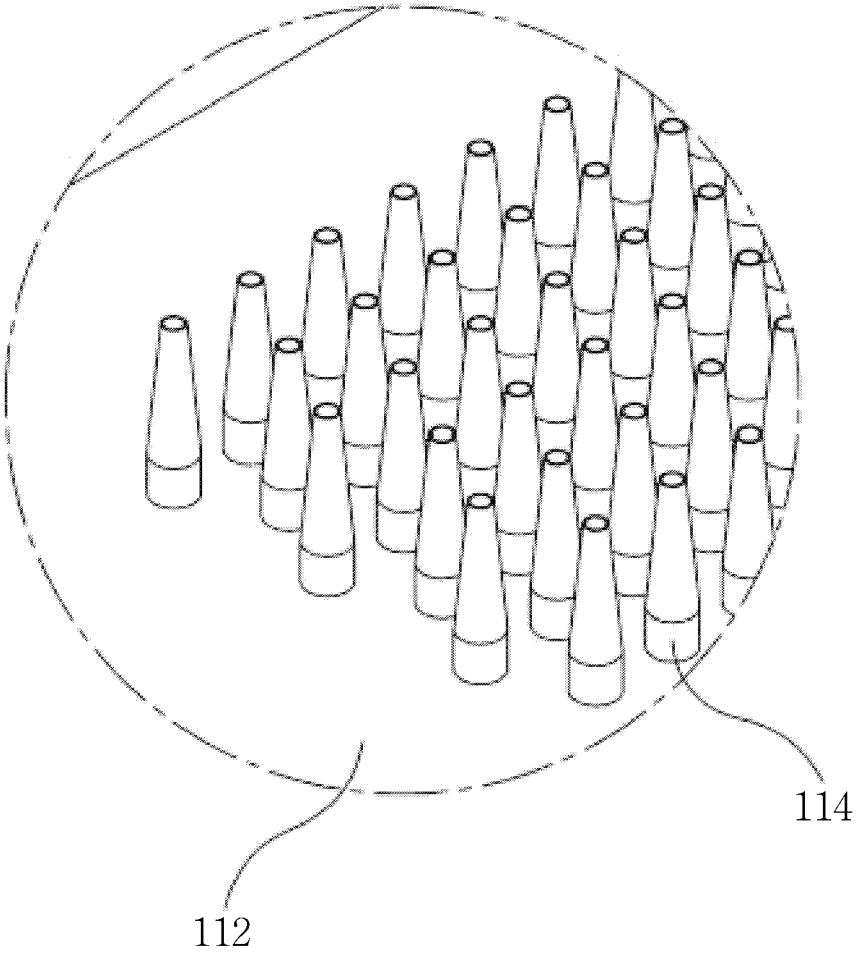
FIG. 6 is an exploded view of the Carl punches illustrated in FIG. 5.

As illustrated in FIGS. 5 and 6, the Carl punching unit 108 includes:

a Carl punching plate 112 having a plurality of through-holes;

Carl punching pins 114 interference-fitted into the through-holes of the Carl punching plate 112 and protruding from the top surface of the Carl punching plate 112 to punch ventilation holes in a seat cover; and a support plate 116 closely fixed to the bottom surface of the Carl punching plate 112 to support the Carl punching plate 112, with through-holes corresponding to the through-holes of the Carl punching plate 112 being formed in the support plate 116;

Here, the through-holes of the support plate 116 are located on the same vertical lines as the through-holes of the Carl punching plate 112, with the inner diameter of the through-holes of the support plate 116 being smaller than the inner diameter of the through-holes of the Carl punching plate 112.

In addition, the Carl punching pins 114 are comprised of groups of Carl punching pins (e.g. a first group, a second group, a third group, . . . , and Nth group of Carl punching pins), which are interference-fitted into the through-holes of the Carl punching plate 112, such that the ventilation holes can be punched in the seat cover in the design desired by the user.

Figure 7:
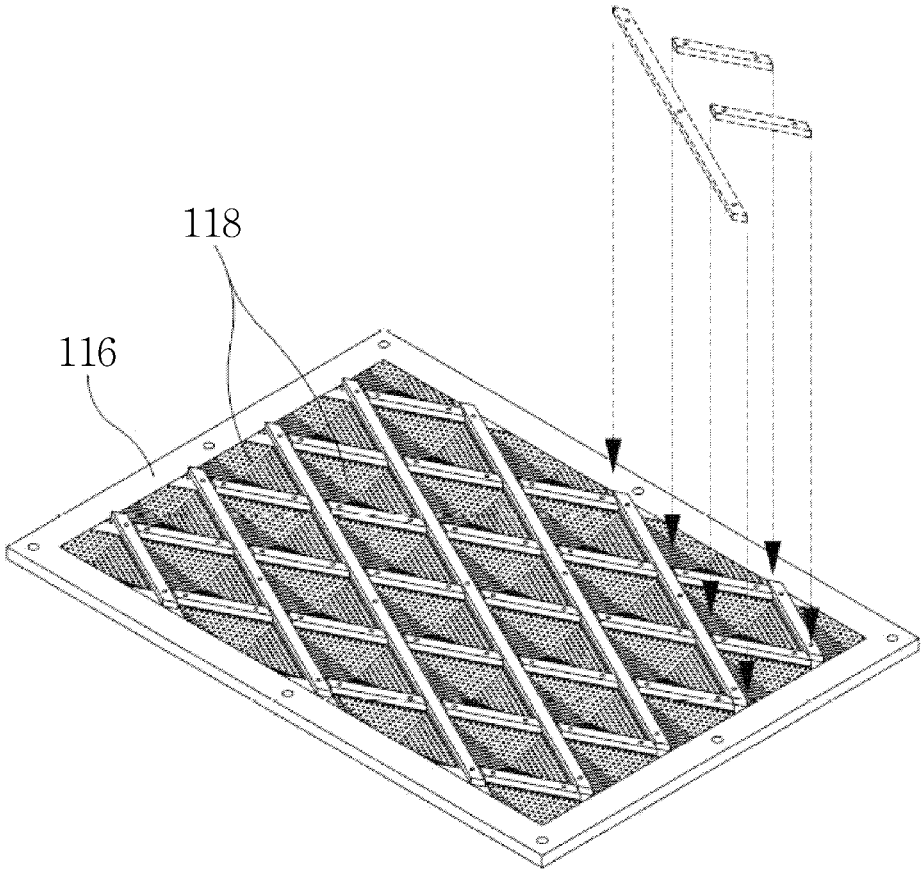
FIG. 7 is a bottom enlarged view of the support plate illustrated in FIG. 5.
Figure 8:
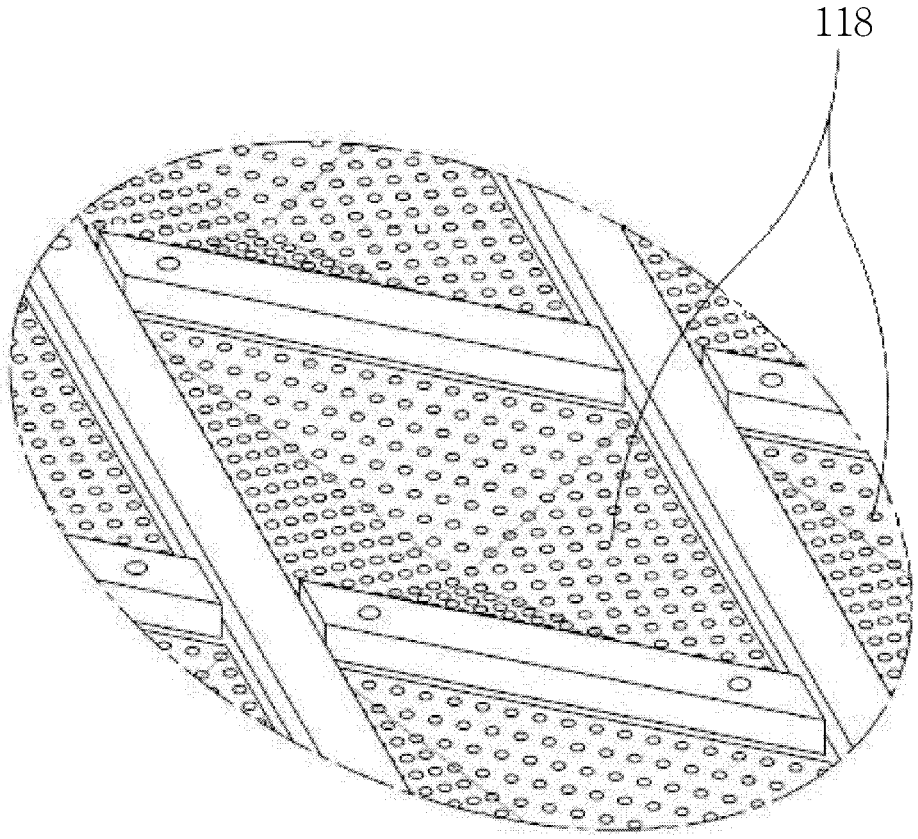
FIG. 8 is an enlarged view of key portions of the support plate illustrated in FIG. 5.

In addition, as illustrated in FIGS. 7 and 8, the bottom surface of the support plate 116 defines force-distributing groups 118 corresponding to the groups of Carl punching pins interference-fitted into the Carl punching plate 112 to distribute force of the Carl punching pins 114 when pressed by the press 110, the bottom surface of the support plate 116 being more inclined toward predetermined portions of the force-distributing groups 118.

The operation of the Carl punching system for a vehicle seat 100 having the above-described configuration, according to the present disclosure, will be described as follows.

Figure 9:
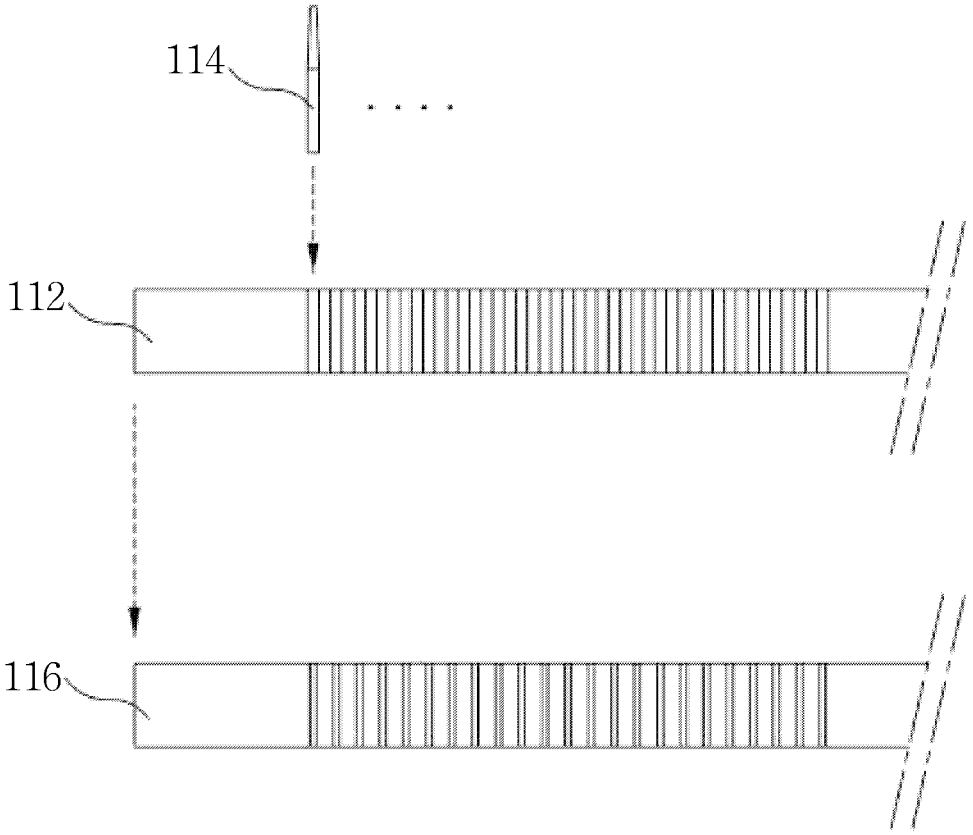
FIGS. 9 and 10 are views illustrating a process of connecting the Carl punch plate, the carl punches, and the support plate of the Carl punching unit.

First, as illustrated in FIG. 9, the support plate 116 having the through-holes is placed in position.

Figure 10:
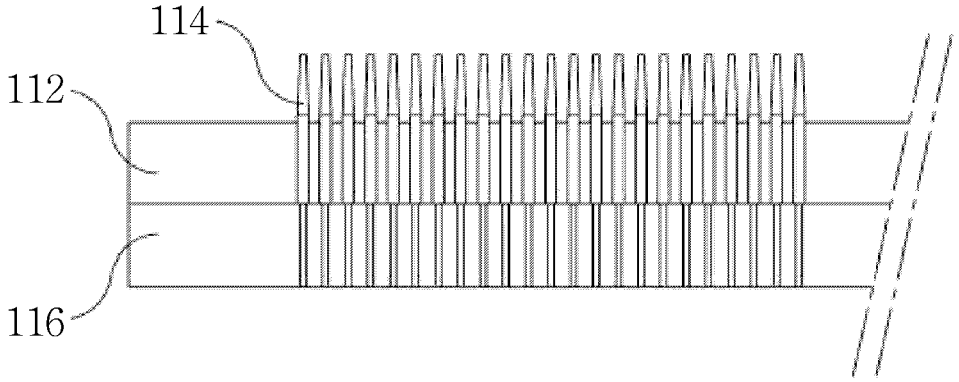

In addition, as illustrated in FIGS. 9 and 10, the Carl punching plate 112 having the through-holes is located on the top surface of the support plate 116.

Here, the through-holes of the support plate 116 are located on the same vertical lines as the through-holes of the Carl punching plate 112, with the inner diameter of the through-holes of the support plate 116 being smaller than the through-holes of the Carl punching plate 112.

In addition, the plurality of Carl punching pins 114, categorized as the first, second, third, . . . , and Nth group of punching pins, are interference-fitted into the through-holes of the Carl punching plate 112 in the design desired by the user, as illustrated in FIGS. 9 and 10.

In addition, as illustrated in FIG. 5, a seat cover 200 to be punched is located on the top surface of the Carl punching plate 112, into which the Carl punching pins 114 are interference-fitted, and then a paper sheet 300 is located on the top surface of the seat cover 200.

In addition, the support plate 116, the Carl punching plate 112, the Carl punching pins 114, the seat cover 200, and the paper sheet 300 are located on the central portion of the top surface of the base 102.

In addition, electric current is supplied to the controller 106. Here, the controller 106 sends a control signal to the press 110.

The press 110 slides downwardly in response to the control signal from the controller 106, thereby pressing the Carl punching pins 114 interference-fitted into the Carl punching plate 112, and moves upwardly to the original position.

In addition, the seat cover 200 Carl-punched in the design desired by the user is released.

Figure 11:
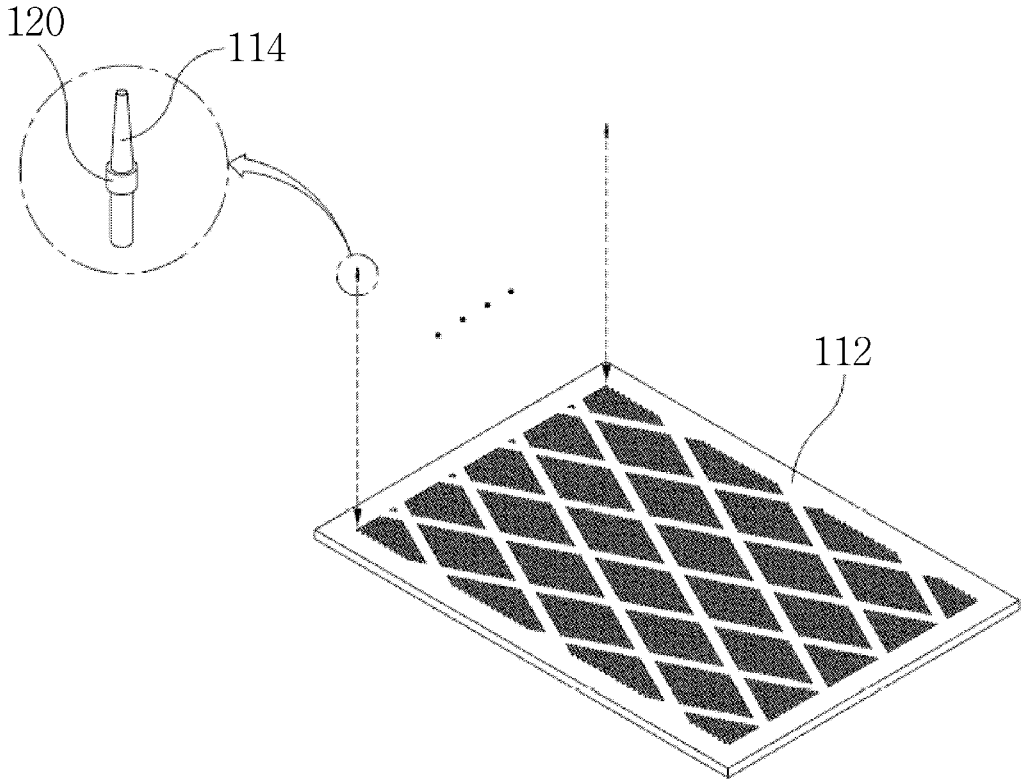
FIG. 11 is a view illustrating another embodiment of the Carl punching unit illustrated in FIG. 4.
Figure 12:
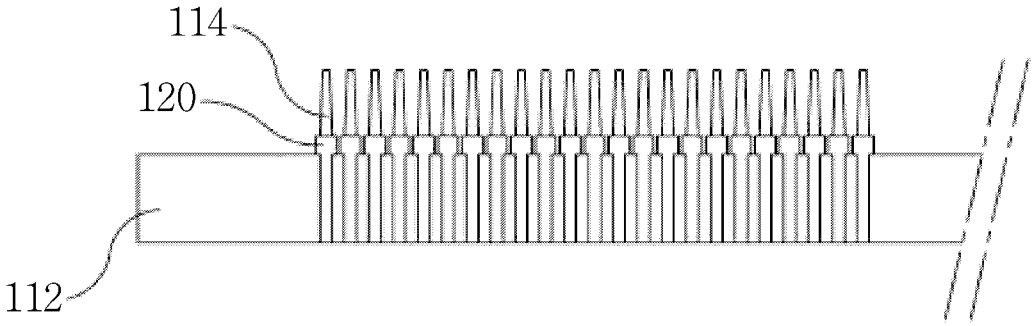
FIG. 12 is a cross-sectional view of the Carl punching unit illustrated in FIG. 11.

On the other hand, FIG. 11 is a view illustrating another embodiment of the Carl punching unit illustrated in FIG. 4, and FIG. 12 is a cross-sectional view of the Carl punching unit illustrated in FIG. 11.

AS illustrated in FIGS. 11 and 12, the Carl punching unit according to another embodiment includes:

a Carl punching plate 112 having a plurality of through-holes; and

Carl punching pins 114 interference-fitted into the through-holes of the Carl punching plate 112 and protruding from the top surface of the Carl punching plate 112 to punch ventilation holes in the sear cover.

Here, each of the Carl punching pins 114 has a flange 120.

The flange 120 is provided on the outer circumference of the central portion of the Carl punching pin 114.

The foregoing descriptions of the present disclosure are used for a better understanding of the present invention but are not used to specify concepts or limit the scope of the present disclosure. A person having ordinary skill in the art will appreciate that a variety of variations and equivalent other embodiments are possible. It should be understood that the true scope of the present disclosure shall be defined by the concept of the appended Claims.

What is claimed is:

1. A Carl punching system a vehicle seat cover, comprising:

a base (102);

guides (104) disposed on a top surface of the base (102), and spaced apart from each other by predetermined distances;

a controller (106) disposed on an outer surface portion of the base (102) to control the Carl punching system a vehicle seat cover, according to a preset program;

a Carl punching unit (108) located on a central portion of a top surface of the base (102) to punch ventilation holes in a seat cover according to a design desired by a user; and a press (110) disposed on the guides (104) to be slidable upwardly or downwardly and electrically connected to the controller (106) to press the Carl punching unit (108) located on the central portion of the top surface of the base (102) in response to a control signal from the controller (106), wherein the Carl punching unit (108) comprises:

a Carl punching plate (112) having a plurality of through-holes;

Carl punching pins (114) interference-fitted into the through-holes of the Carl punching plate (112) and protruding from a top surface of the Carl punching plate (112) to punch ventilation holes in a seat cover; and a support plate (116) closely fixed to a bottom surface of the Carl punching plate (112) to support the Carl punching plate (112), with through-holes corresponding to the through-holes of the Carl punching plate (112) being formed in the support plate (116), wherein the through-holes of the support plate (116) are located on the same vertical lines as the through-holes of the Carl punching plate (112), with an inner diameter of the through-holes of the support plate (116) being smaller than an inner diameter of the through-holes of the Carl punching plate (112), wherein the Carl punching pins (114) are comprised of groups of Carl punching pins, such as a first group, a second group, a third group, . . . , and Nth group of Carl punching pins, interference-fitted into the through-holes of the punching plate 112, such that the ventilation holes are punched in the seat cover in the design desired by the user, wherein a bottom surface of the support plate (116) defines force-distributing groups (118) corresponding to the groups of Carl punching pins interference-fitted into the Carl punching plate (112) to distribute force of the Carl punching pins (114) when pressed by the press (110), the bottom surface of the support plate (116) being more inclined toward predetermined portions of the force-distributing groups (118), wherein each of the Carl punching pins (114) comprises a flange (120) on outer circumferential portions of a central portion thereof, wherein, after a seat cover (200) to be punched is located on the top surface of the Carl punching plate (112), into which the Carl punching pins (114) are interference-fitted, a paper sheet (300) is located on top surface of the seat cover (200).

* * * * *